United States Patent [19]

Williamson et al.

[11] Patent Number: 4,869,642

[45] Date of Patent: Sep. 26, 1989

[54] VARIABLE OUTPUT VORTEX PUMP

[75] Inventors: John R. Williamson, Paradise Valley; Christopher D. Eick, Phoenix, both of Ariz.

[73] Assignee: Allied-Signal Inc., Phoenix, Ariz.

[21] Appl. No.: 204,457

[22] Filed: Jun. 9, 1988

[51] Int. Cl.[4] ..... F01D 17/00

[52] U.S. Cl. ..... 415/146; 415/26; 415/49

[58] Field of Search ..... 415/11, 26, 27, 28, 415/49, 146, 148, 149 R

[56] References Cited

U.S. PATENT DOCUMENTS

| | | | |
|---|---|---|---|
| 916,427 | 3/1909 | Fee | 415/146 |
| 2,803,396 | 8/1957 | Darrow | 415/146 |
| 3,032,259 | 5/1962 | Jassniker | 415/148 |
| 3,365,120 | 1/1968 | Jassniker | 415/26 |
| 3,391,859 | 7/1968 | Waldman | 415/146 |
| 3,426,964 | 2/1969 | Silvern | 415/49 |
| 3,608,088 | 9/1971 | Dorman et al. | 415/10 |
| 3,610,770 | 10/1971 | Hendriks | 415/159 |
| 3,868,196 | 2/1975 | Lown | 415/146 |
| 4,155,221 | 5/1979 | Dhoore et al. | 415/145 |
| 4,254,791 | 3/1981 | Bron | 137/118 |
| 4,378,194 | 3/1983 | Bandukwalla | 415/49 |
| 4,460,310 | 7/1984 | Plunkett | 415/26 |

FOREIGN PATENT DOCUMENTS 616429 7/1978 U.S.S.R. .

OTHER PUBLICATIONS

U. M. Barske, The Design of Open Impeller Centrifugal Pumps, 7/1953, Report to the Royal Aircraft Establishment, Farnborough, England.

*Primary Examiner*—Robert E. Garrett
*Assistant Examiner*—John T. Kwon
*Attorney, Agent, or Firm*—R. Steven Linne; James W. McFarland

[57] ABSTRACT

A high speed liquid vortex pump is fitted with a flexible tube in the discharge throat. The flow area of the flexible tube, and thus the pump output flow rate, is varied by surrounding the tube with a pressure modulated stream of the working fluid.

20 Claims, 3 Drawing Sheets

VARIABLE OUTPUT VORTEX PUMP

TECHNICAL FIELD

This invention relates generally to rotary fluid pumps and more specifically to a high speed, forced vortex, liquid pump having an output flow control which is responsive to a pressure modulated stream of the working fluid.

BACKGROUND OF THE INVENTION

High speed, forced vortex pumps have been known since at least the early 1940's when they were investigated by Dr. U. M. Barske for use in rocket propulsion systems but they have not found wide commercial use since, probably because of their unfamiliar pumping characteristics. Physically, they somewhat resemble the common centrifugal pump but they operate on altogether different principles. A centrifugal pump uses a screw-shaped or scrolled impeller to force all the fluid which enters the pump to be thrown outwardly into an annular discharge channel. Since the fluid moves quickly through the pump, the residence time for any particular portion of the fluid is very short, often less than one revolution of the impeller, thus there is a considerable difference in relative speed between the fluid and the impeller. The characteristics of such pumps are generally well-known and they are commonly used to supply very large flows of fluids at low to moderate pressures.

In contrast, a forced vortex pump (not to be confused with a liquid-ring pump) is based on rapidly rotating a body of fluid and withdrawing only a small portion of the fluid so that the remainder may be considered, for design purposes, almost as a rotating solid body. In its original form, such a pump consisted of a rotating drum with baffles or blades fixed to its inside walls for developing the rotating body. Fluid entered the drum through its hub and was picked up near its periphery by a stationary, internal pickup tube which exited the drum through the hub. Difficulties with adapting this design for various applications led to an inverted design in which a simple, straight impeller with long blades was used to create a rapidly rotating fluid vortex within a short cylindrical cavity within a fixed housing surrounding the rotating impeller. The outer portion of the fluid vortex, adjacent the smooth housing wall, is at a high pressure while the inner portion is at a much lower pressure. Typically, the high pressure fluid is extracted from the housing through a tangential diffuser section where much of the kinetic energy (velocity) of the fluid is converted to static or potential energy (pressure). The pressure level at the discharge is determined by the diameter and rotational speed of the impeller, while the maximum output flow rate is directly related to the size of the diffuser throat at any given rotational speed. Very small, simple pumps can put out moderate flows at high pressure if all the components are carefully designed. More importantly, the output pressure is practically constant for all rates of flow at any given speed and the output capacity is approximately proportional to the impeller speed (up to a maximum value determined by the number and size of the discharge). This characteristic is sometimes a disadvantage. For example, one potential application of such pumps is in a fuel supply system for gas turbine engines. However, in such a system the pump would preferably be driven at a fixed speed determined by the rotational speed of the turbine engine rather than at a variable speed determined by fuel flow required. Such systems would then necessarily include a separate hydromechanical fuel control unit to regulate the amount of fuel delivered to the engine. Such control units are usually very complex and expensive. What is needed is a simple and inexpensive way to vary the pump output directly.

In view of the foregoing, it should be apparent that there is a need in the art for improvements in the design and construction of high speed vortex pumps.

It is therefore an object of the present invention to provide an improved method and apparatus for controlling the output flow rate of a vortex pump.

It is another object of the invention to provide a simple electrically actuated flow control device for a fluid pump operating at a fixed rotational speed.

SUMMARY OF THE INVENTION

The present invention aims to overcome the disadvantages of the prior art as well as offer certain other advantages by providing a novel vortex pump fitted with a flexible tube in the discharge throat. The flow area of the flexible tube, and thus the pump output flow rate, is varied by surrounding the tube with a pressure modulated stream of the working fluid.

Preferably, the stream pressure is controlled by an electrical motor, solenoid, or other device which moves a valve member to variably cover and uncover a bypass passage to allow a portion of the high pressure working fluid to recirculate to the pump inlet while another portion flows to the exterior of the flexible tube to partially collapse it, thereby reducing the flow area of the discharge throat.

BRIEF DESCRIPTION OF THE DRAWINGS

While this specification concludes with claims particularly pointing out and distinctly claiming the subject matter which is regarded as the invention, it is believed that the objects, features, and advantages thereof may be better understood from the following detailed description of a presently preferred embodiment when taken in connection with the accompanying drawings in which:

BEST MODE FOR CARRYING OUT THE INVENTION

Figure 1:
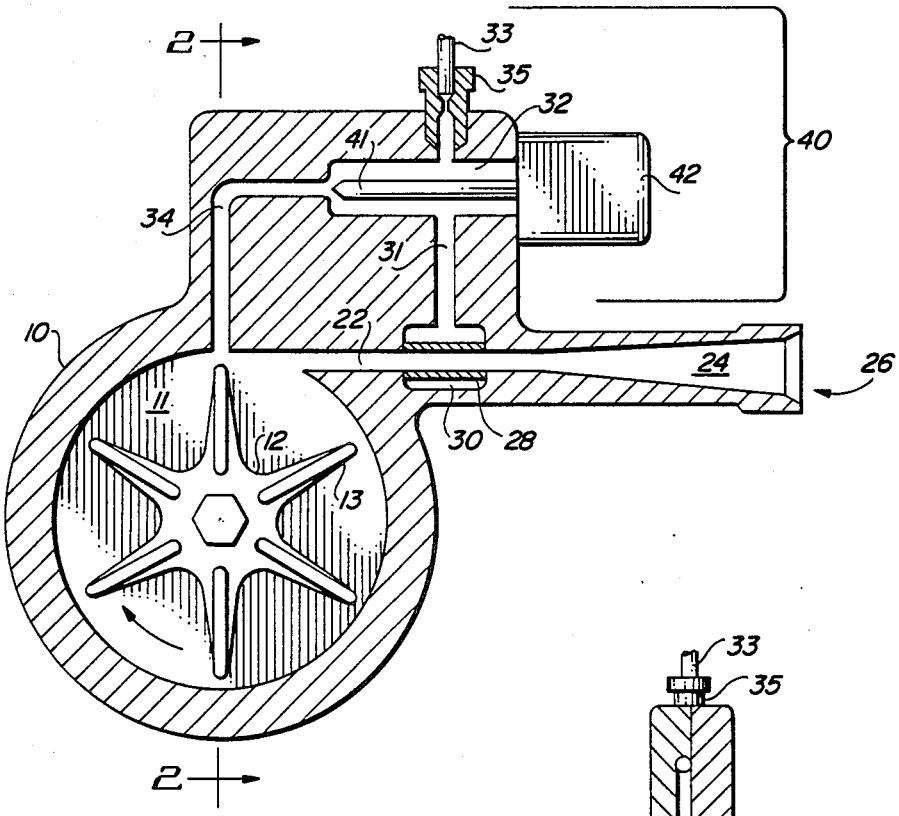
FIG. 1 is a schematic illustration of one embodiment of the present invention showing a vertical cross-sectional view taken in a plane perpendicular to the longitudinal axis of the pump, while 1*a* shows a variation thereof.
Figure 2:
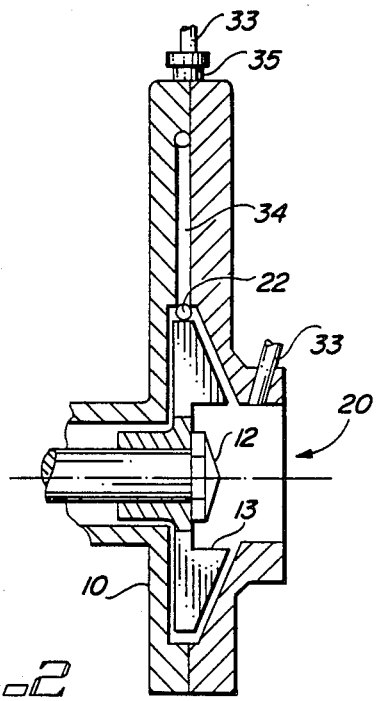
FIG. 2 is a cross-sectional illustration taken parallel to the pump axis along lines 2—2 of FIG. 2.
Figure 1A:
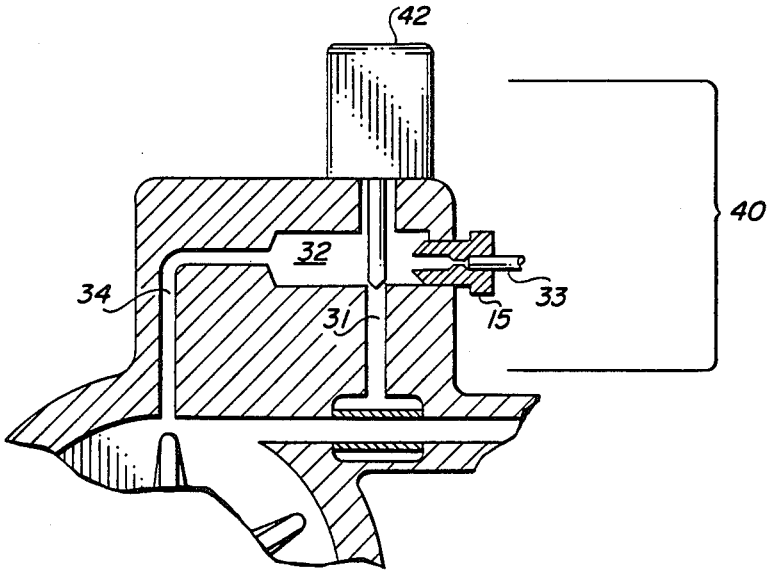

Referring to FIGS. 1 and 2, a rigid housing (10) contains a generally cylindrical pumping cavity called the pump bowl (11). The bowl (11) contains a rotatable impeller (12) having a number of straight blades (13) extending radially therefrom for rotating fluid in the bowl (11).

The housing (10) also contains a liquid inlet (20) to the center of the bowl (11) and a main liquid outlet having two sections. A straight, tubular, throat section (22) extends tangentially from the periphery of the bowl (11). The throat (22) extends into a conically diverging diffuser section (24) which may be connected, at its free end (26), to downstream piping (not shown).

A portion of the throat (22) is made up of a flexible tube (28), such as rubber or other elastomeric material, which may be deformed to create a variable throat flow area. The force necessary to partially collapse the flexible tube (28) is supplied by a small amount of the high pressure working fluid acting in an annular pressure chamber (30) surrounding a portion of the flexible tube (28). A control passage (31) connects the chamber (30) with a variable pressure cavity (32) formed within the housing (10). This cavity (32) has a fluid outlet or bypass conduit (33) containing a restrictor (35) and a fluid inlet or supply tube (34) which is in communication with the high pressure liquid in the pump bowl (11). Within the variable pressure cavity (32) is a valve means (40) for varying or modulating the fluid pressure in the control passage (31). Preferably, the valve means (40) consists of a valve member (41) which is movable by an electrical motive device (42) so as to restrict fluid flow through the cavity (32) while allowing excess fluid to recirculate back to a supply tank (not shown) or to the pump inlet through the bypass conduit (33). The fluid pressure in the cavity (32) thus varies depending on the pressure drop across the restriction.

In FIG. 1, the electrical device (42) is a linear stepper motor which axially moves a tapered pin (41) so as to variably change the area of the supply tube (34).

Figure 3A:
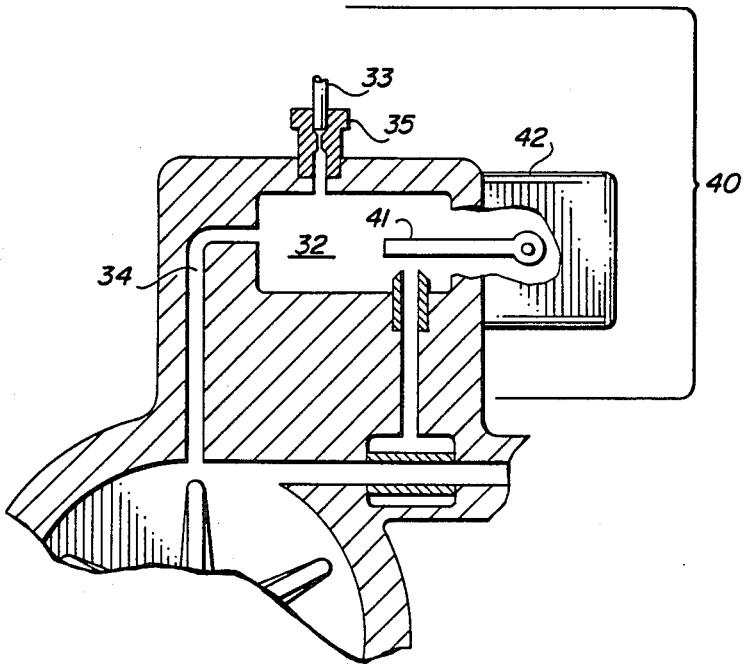
FIG. 3 is an illustration of another embodiment of the present invention while 3*a* shows a variation thereof.
Figure 3:
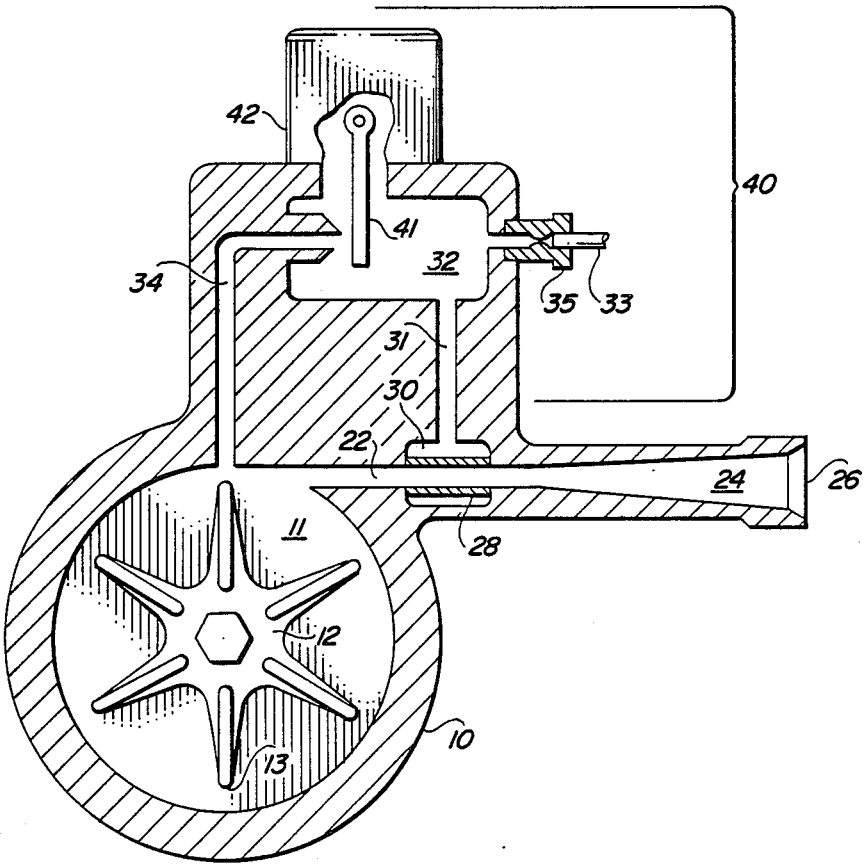

In FIG. 3, the electrical device (42) is a torque motor which rotates a flapper valve member (41) so as to variably block the supply tube (34). In either of these embodiments, the valve member (41) could be located so as to block or cover the bypass conduit (33) instead of the supply tube if the restrictor is located in the supply tube (35). In addition, the bypass conduit (33), if large or close to the inlet, may require an additional fixed flow restrictor (35) in the flow path in order to ensure that there is always sufficient pressure available in the variable pressure cavity (32) to deform the flexible tube (28) to the maximum amount desired.

During use, the impeller (12) is rotated at high speed, e.g. several thousand revolutions per minute. A liquid, such as fuel, is supplied to the pump inlet (20) and flows into the pump bowl (11). The rotating impeller blades (13) force the liquid to spin and form a vortex within the bowl (11). Since the pressure of a spinning liquid increases approximately according to the square of the radius of revolution, the pressure near the tips of the blades (13) will be much greater than near the inlet (20). A useable portion of the high pressure liquid is withdrawn through the tangential outlet (26) while a small portion is used to control the output flow rate then recirculated to the pump inlet. This control portion flows from the pump bowl (11) through a supply tube (34), which is at least initially perpendicular to the pump axis, into the variable pressure cavity (32) and then through the bypass conduit (33). A valve member (41) partially blocks the flow from the supply tube (34) so as to cause the fluid pressure in the cavity (32) to vary depending on the degree of blockage. That is, the greater the blockage, the lower the flow and thus the lower the pressure in the cavity. The pressure within the cavity (32) is transmitted through control passage (31) to the pressure chamber (30) surrounding the flexible tube (28) in the throat (22) of the main fluid outlet (26). Even though there is a pressure drop at the outlet of the supply tube (34) due to the partial blockage by the valve member (41), the pressure in the cavity (32), and thus in chamber (30), is always (except at zero flow) greater than the pressure of the fluid rapidly flowing through the flexible tube (28). Due to the very high fluid velocity through the throat (22), the fluid pressure is very low within the flexible tube (28). However, to ensure sufficient pressure to permit maximum desirable deformation of the flexible tube, it is usually necessary to insert a flow restrictor (35) such as a fixed-sized orifice, in the bypass conduit (33).

In order to reduce the pump output flow rate to any desired value, an electrical signal is sent to the motive device (42) so that valve member (41) is moved away from the supply tube outlet (34). As more fluid flows into the cavity (32), the pressure increases in the control passage (31) which causes the flexible tube (28) to partially collapse. Since the cross-sectional flow area of the throat (22) is thereby reduced, the output flow rate is proportionally reduced. Since the pressure of the liquid in the pump bowl (11) is not significantly affected by the reduction in output flow rate, the control system is inherently stable. This is contrary to what would be expected if the pump was a conventional centrifugal pump in which the pressure increases as the output is restricted.

While in order to comply with the statute, this invention has been described in terms more or less specific to one or two preferred embodiments, it is expected the various alterations, modifications, or permutations thereof will be apparent to those skilled in the art. For example, the flexible tube may be replaced by a flexible membrane in a non-circular duct; the valve member could be mechanically moved; or the valve means could even be remote from the housing. Therefore, it should be understood that the invention is not to be limited to the specific features shown or described but it is intended that all equivalents be embraced within the spirit and scope of the invention as defined by the appended claims.

What is claimed is:

1. A rotary fluid pump comprising in combination: a housing forming a generally cylindrical pump bowl therein; said housing having a fluid inlet aligned with the longitudinal axis of said generally cylindrical pump bowl and in communication therewith;

an impeller located within, and rotatable about the longitudinal axis of, said bowl; said impeller having a plurality of radially extending blades;

a fluid outlet in said housing extending tangentially from the periphery of said pump bowl and having a first, generally tubular, throat section, in communication with said bowl, and a second outwardly diverging conical section downstream of said first section;

a flexible tube making up at least a portion of said throat section;

a pressure chamber within said housing and surrounding at least a portion of said flexible tube;

a control passage within said housing and in flow communication between said pressure chamber and said pump bowl; and valve means within the flow path of said control passage for adjusting the pressure of fluid in said pressure chamber whereby the cross-sectional flow area of said flexible tube may be reduced by increasing the fluid pressure in said chamber sufficiently to partially collapse said tube.

2. The pump of claim 1 wherein said control passage includes an enlarged cavity, for containing said valve means, and a bypass conduit communicating between said cavity and said pump inlet whereby the pressure of fluid within said cavity may be adjusted by controlling the amount of fluid flowing through said cavity and into said bypass conduit.

3. The pump of claim 2 wherein said valve means includes an electrically controlled motive device; and a valve member attached to and movable by said motive device.

4. The pump of claim 3 wherein said motive device is a linear stepper motor and said valve member is a tapered pin which is movable to variably restrict the amount of fluid flowing into said cavity.

5. The pump of claim 3 wherein said motive device is a torque motor and said valve member is a flapper which is rotatable to vary the amount of fluid flowable into said cavity.

6. The pump of claim 3 wherein said motive device is a linear stepper motor and said valve member is a tapered pin which is movable to variably restrict the amount of fluid flowing out of said cavity through said bypass conduit.

7. The pump of claim 3 wherein said motive device is a torque motor and said valve member is a flapper which is rotatable to vary the amount of fluid flowable out of said cavity through said bypass conduit.

8. The pump of claim 1 wherein said impeller has three to twelve radially extending straight, flat blades.

9. The pump of claim 1 wherein at least a first portion of said control passage initially extends radially from said cylindrical pump bowl.

10. A method of controlling the output flow rate of a forced-vortex pump of the type having a housing forming a cylindrical pump bowl containing a rotatable impeller, an axial fluid inlet, and a tangential fluid outlet, comprising the steps of:

introducing liquid to be pumped into said pump bowl through said axial inlet;

rotating said impeller to cause said liquid to rapidly rotate within said pump bowl;

withdrawing a first stream of the rotating liquid from said pump bowl through said tangential fluid outlet;

providing a flexible tube in at least a portion of the flow path of said first stream through said tangential fluid outlet:

withdrawing a second stream of the rotating liquid from said pump bowl;

modulating the pressure of said second stream to form a control stream of the pumped liquid;

transmitting the pressure modulated control stream to the exterior of said flexible tube and thereby partially collapsing said tube to restrict the flow of said first stream therethrough.

11. The method of claim 10 wherein the step of modulating the pressure of said second stream includes the steps of flowing said second stream into and through a cavity which is in communication with the exterior of said flexible tube;

restricting the flow of said second stream through said cavity by moving a valve member into the flow path and flowing excess fluid out of said cavity through a bypass conduit, thereby modulating the pressure of the fluid within said cavity.

12. The method of claim 11 wherein the step of flowing excess fluid out of said cavity through a bypass conduit includes flowing the fluid back to the pump inlet.

13. The method of claim 12 wherein the step of moving a valve member into the flow path includes the steps of:

providing an electrically controlled motive device attached to said valve member, causing said motive device to move said valve member so as to partially block said second stream flowing into said cavity.

14. The method of claim 13 wherein said motive device is a torque motor and said valve member is a flapper which is rotated to partially block said second stream.

15. In a high speed, forced vortex liquid pump of the type having a high pressure liquid outlet extending tangentially from the periphery of a cylindrical pump bowl, the combination of a flexible tube in said liquid outlet and means for deforming said flexible tube to reduce its cross-sectional area and thereby regulate the liquid flow rate therethrough, wherein said means for deforming includes means for modulating the pressure of a stream of the pumped liquid and means for transmitting said pressure modulated stream to the exterior of said flexible tube whereby said tube may be partially collapsed by said pressure.

16. The pump of claim 15 wherein said means for modulating includes an electrically controlled valve in the flow path of said stream for varying the pressure thereof.

17. The pump of claim 15 wherein said means for modulating includes a cavity having an entrance for accepting said stream of pumped liquid, a valve member movable to partially block said entrance and a bypass conduit for removing excess liquid from said cavity, whereby the pressure of the liquid in the cavity is variable depending on the degree of blockage provided by said valve member.

18. The pump of claim 17 wherein said bypass conduit is in flow communication with the pump inlet and contains a flow restriction for limiting the flow therethrough.

19. The pump of claim 17 wherein said valve member is connected to an electrically controlled motive device whereby the pump output flow rate may be adjusted by an electrical signal to said device.

20. Variable output vortex pump apparatus comprising:

rotatable impeller means for liquid immersion and rotation about an axis to force liquid adjacent said impeller means to rotate as a fluid vortex substantially in unison therewith, said fluid vortex having a centrifugal pressure head and a tangential velocity head;

housing means defining an inlet passage leading axially to said impeller, a first chamber rotatably receiving said impeller and including a circumferential wall proximate to and radially outwardly of said impeller, and at least two outlet passages leading from said first chamber to respective outlet ports;

the first of said outlet passages extending through said wall generally tangentially in the direction of vortex rotation and being substantially of constant cross sectional flow area for rapidly flowing a portion of said fluid from said fluid vortex having said centrifugal pressure head and said tangential velocity head;

a yieldably shape retaining member cooperating with said housing to bound said first passage and to define a second chamber, said shape retaining member being movable between a first position wherein said first passage is of substantially constant cross sectional flow area and a second position constricting said first passage in response to greater fluid pressure communicating to said second chamber;

the second of said two outlet passages extending outwardly from said first chamber to communicate both with said second chamber and via the respective outlet port with a source of comparatively low pressure;

a pair of restrictive communication means serially disposed in said second passage, one between said first chamber and said second chamber, and the other downstream thereof and between said second chamber and said source of low pressure;

and means for selectively varying the fluid flow resistance of one of said pair of restrictive communication means to trap in or admit to said second chamber said greater fluid pressure;

whereby said second passage flows a portion of said fluid from said fluid vortex to result in said greater fluid pressure in said second chamber.

* * * * *